US007980551B2

(12) United States Patent
Kobayashi

(10) Patent No.: US 7,980,551 B2
(45) Date of Patent: Jul. 19, 2011

(54) FEED DEVICE AND RECORDING DEVICE

(75) Inventor: Satoshi Kobayashi, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/511,925

(22) Filed: Jul. 29, 2009

(65) Prior Publication Data

US 2010/0025922 A1 Feb. 4, 2010

(30) Foreign Application Priority Data

Jul. 30, 2008 (JP) ..... 2008-196776

(51) Int. Cl.
*B65H 3/52* (2006.01)

(52) U.S. Cl. ..... 271/121; 271/167; 271/119

(58) Field of Classification Search ..... 271/119, 271/120, 121, 126, 127, 167
See application file for complete search history.

(56) References Cited

U.S. PATENT DOCUMENTS

| | | | | |
|---|---|---|---|---|
| 4,667,244 | A * | 5/1987 | Ishikawa | 358/498 |
| 5,435,539 | A * | 7/1995 | Namiki | 271/114 |
| 5,545,882 | A * | 8/1996 | Tanaka | 235/98 R |
| 5,549,289 | A * | 8/1996 | Sonnenburg et al. | 271/121 |
| 5,820,121 | A * | 10/1998 | Lan | 271/121 |
| 6,059,281 | A * | 5/2000 | Nakamura et al. | 271/119 |
| 6,126,161 | A * | 10/2000 | Kato | 271/121 |
| 6,139,006 | A * | 10/2000 | Asada | 271/121 |
| 6,322,066 | B1 * | 11/2001 | Rong | 271/119 |
| 6,331,002 | B1 * | 12/2001 | Yoshino et al. | 271/117 |
| 6,655,679 | B2 * | 12/2003 | Boucher et al. | 271/119 |
| 6,663,098 | B2 * | 12/2003 | Teo et al. | 271/121 |
| 6,755,413 | B2 * | 6/2004 | Takai | 271/119 |
| 7,040,614 | B2 * | 5/2006 | Sonoda et al. | 271/125 |
| 7,469,889 | B2 * | 12/2008 | Kamijoh | 271/121 |
| 7,478,805 | B2 * | 1/2009 | Liu et al. | 271/121 |
| 7,484,723 | B2 * | 2/2009 | Kuo et al. | 271/10.09 |
| 7,556,258 | B2 * | 7/2009 | Bergander et al. | 271/120 |
| 7,614,622 | B2 * | 11/2009 | Muramatsu | 271/119 |
| 7,708,267 | B2 * | 5/2010 | Shigeno | 271/122 |
| 7,841,592 | B2 * | 11/2010 | Wu et al. | 271/121 |
| 2003/0201596 | A1 * | 10/2003 | Teo et al. | 271/121 |
| 2007/0063422 | A1 * | 3/2007 | Kuo et al. | 271/121 |
| 2008/0315497 | A1 * | 12/2008 | Kobayashi | 271/10.09 |

FOREIGN PATENT DOCUMENTS

| | | |
|---|---|---|
| JP | 08-091612 | 4/1996 |
| JP | 2009-001366 | 1/2009 |

* cited by examiner

*Primary Examiner* — Kaitlin S Joerger
(74) *Attorney, Agent, or Firm* — Maschoff Gilmore & Israelsen

(57) ABSTRACT

Provided is a feed device including: a loading unit in which a plurality of recording mediums is loaded in a stacked state; a delivery mechanism which has a first outer circumferential surface set such that friction force with the recording mediums is greater than friction force generated among the plurality of recording mediums when a feed operation is performed in a state of being in contact with the recording mediums and a second outer circumferential surface having a hardness higher than that of the first outer circumferential surface, and which performs the feed operation in a state in which at least the first outer circumferential is in contact with an uppermost recording medium of the recording mediums loaded on the loading unit so as to deliver the recording medium in a feed direction; a gate member and a gate energizing member.

6 Claims, 8 Drawing Sheets

FEED DEVICE AND RECORDING DEVICE

BACKGROUND

1 . Technical Field

The present invention relates to a feed device such as a paper feed device and a recording device such as an ink jet printer including the feed device.

2 . Related Art

Existing recording devices such as printers include a paper feed device (feed device) for automatically feeding paper to a recording unit while separating a plurality of sheets of paper loaded (that is, stacked) in a stacked state one by one so as to continuously perform recording with respect to the plurality of sheets of paper (recording medium) (for example, JP-A-8-91612).

The feed device of JP-A-8-91612 includes a paper feed cassette (loading unit) in which a plurality of sheets of paper can be stacked, a paper feed roller which rotates in a state of being in contact with uppermost sheet of paper of the sheets of paper stacked and delivers the uppermost sheet in a feed direction, and a gate member for preventing double feed of the uppermost sheet of paper and its underlying paper in the feed direction.

In detail, this gate member is configured such that one end side thereof is oscillatorily supported as a fulcrum and the other end side thereof is placed in contact with an outer circumferential surface of the paper feed roller with a predetermined pressure by the energizing force of a compression spring. In addition, an inclined surface is provided in the other end side of the gate member at a location where the front end of a piece of paper delivered by the paper feed roller may collide therewith. If the front end of the paper delivered by the paper feed roller in the feed direction collides with the inclined surface, the gate member, whose inclined surface is pressed by the paper, oscillates against the energizing force of the compression spring in a direction separate from the outer circumferential surface of the paper feed roller and thus a gap through which only a single sheet of paper may pass is formed between the paper feed roller and the gate member. Accordingly, only uppermost sheet of paper is fed through the gap in the feed direction. If the uppermost sheet of paper and its underlying paper are double fed by the friction force therebetween, the double feed of the paper underlying the uppermost sheet of paper is prevented by the inclined surface of the gate member.

However, in such a feed device, in order to ensure friction force for delivering the paper, the outer circumferential surface of the paper feed roller is mostly formed of a soft material such as rubber. Accordingly, as in JP-A-8-91612, if the other end side of the gate member is in contact with the paper feed roller in an energized state, in particular, in the environment in which the temperature or humidity is high, the outer circumferential surface of the paper feed roller may be deformed. In order to press the inclined surface by the paper so as to oscillate the gate member such that a gap through which only a single sheet of paper can pass is formed between the gate member and the outer circumferential surface of the paper feed roller, the contact angle between the delivered paper and the inclined surface of the other end of the gate member is of importance. However, for example, if the outer circumferential surface of the paper feed roller is recessed by the pressing of the gate member such that the contact angle between the paper and the inclined surface is changed, the gap may not be formed with high precision.

In addition, in addition to the paper feed device of the printer, such a problem may generally be generated in a feed device for feeding a plurality of recording mediums stacked while separating the recording mediums.

SUMMARY

An advantage of some aspects of the invention is that it provides a feed device capable of preventing double feed of recording mediums with high precision and a recording device including the feed device.

According to an aspect of the invention, there is provided a feed device including: a loading unit in which a plurality of recording mediums is loaded in a stacked state; a delivery mechanism which has a first outer circumferential surface set such that friction force with the recording mediums is greater than friction force generated among the plurality of recording mediums when a feed operation is performed in a state of being in contact with the recording mediums and a second outer circumferential surface having hardness higher than that of the first outer circumferential surface, and which performs the feed operation in a state in which at least the first outer circumferential is in contact with the uppermost recording medium of the recording mediums loaded on the loading unit so as to deliver the recording medium in a feed direction; a gate member which is configured to be moved in a direction approaching or separating from the second outer circumferential surface of the delivery mechanism and which has an inclined surface with which a front end of the recording medium delivered by the delivery mechanism collides; and a gate energizing member which energizes the gate member in a direction approaching the second outer circumferential surface of the delivery mechanism, wherein, in the uppermost recording medium which is delivered by the delivery mechanism such that the front end thereof collides with the inclined surface of the gate member, a gap through which only the uppermost recording medium passes is formed between the delivery mechanism and the gate member by moving the gate member against the energizing force of the gate energizing member in the direction separating from the delivery mechanism.

By this configuration, the uppermost recording medium which is delivered by the delivery mechanism such that the front end thereof collides with the inclined surface of the gate member is fed by forming a gap through which only the uppermost recording medium may pass between the delivery mechanism and the gate member against the energizing force of the gate energizing member such that the uppermost recording medium and its underlying recording medium are separated so as to prevent double feed. In addition, since the delivery mechanism has the first outer circumferential surface set such that the friction force with the recording mediums is greater than the friction force generated between the plurality of recording mediums when a feed operation is performed in a state of being in contact with the recording mediums and the second outer circumferential surface having a hardness higher than that of the first outer circumferential surface, the first outer circumferential surface may be formed of rubber with high friction force, and the second outer circumferential surface may be formed of plastic which is hard to deform and has a hardness higher than that of rubber. Accordingly, by feeding the recording medium by the first outer circumferential surface and separating the recording medium in cooperation of the gate member energized by the gate energizing member by the second outer circumferential surface of which the deformation is suppressed, it is possible to prevent the double feed of the recording mediums with high precision.

In the feed device of the invention, the delivery mechanism may include a feed roller which has the first outer circumferential surface and is supported so as to be rotated around a rotary shaft and guide rollers which have the second outer circumferential surface and is supported so as to be rotated around the rotary shaft.

By this configuration, since the feed operation of the delivery mechanism can be realized by the rotation of the feed roller and the guide rollers, it is possible to deliver the recording medium with smooth continuous motion. Since the first outer circumferential surface and the second outer circumferential surfaces are configured by the feed roller and the guide rollers which are supported to be rotated around the same rotary shaft, a separate rotary shaft for supporting the guide rollers is unnecessary and the increase in the number of parts can be suppressed.

In the feed device of the invention, the guide rollers may be disposed at both sides of the feed roller in an axial direction of the rotary shaft, and the first outer circumferential surface of the feed roller and the second outer circumferential surface of the guide roller may be substantially flush with each other.

By this configuration, since the recording medium can be delivered by the feed roller located at the central portion in the axial direction of the rotary shaft and the recording medium can be separated by the guide rollers and the gate member positioned at both sides of the feed roller, it is possible to perform separation with certainty without tilting the recording medium in the feed direction. Since the first outer circumferential surface and the second outer circumferential surface disposed at both sides thereof are flush with each other, it is possible to perform separation with certainty without causing unbalance in pressure due to the contacting of the gate member or the gap formed with the gate member.

In the feed device of the invention, each of the feed roller and the guide rollers may have a circumferential surface having a distance from the rotary shaft as a radius and a non-circumferential surface having a distance from the rotary shaft shorter than that of the circumferential surface in the outer circumferential surface, the circumferential surface of the feed roller may form the first outer circumferential surface, and the circumferential surface of each of the guide rollers may form the second outer circumferential surface, the second outer circumferential surface may be set such that friction force with the recording mediums is less than friction force generated between the plurality of recording medium when the guide rollers are rotated in a state of being in contact with the recording mediums, and the feed roller and the guide rollers may be configured to be synchronously rotated by the rotary driving of the rotary shaft.

By this configuration, since each of the feed roller and the guide rollers includes the circumferential surface and the non-circumferential surface in the outer circumferential surface, the recording medium can be delivered and separated by the circumferential surface and the non-circumferential surface can be set so as not to be in contact with the recording medium or the gate member. Accordingly, it is possible to suppress the deformation of the outer circumferential surface, compared with the case where the gate member is always in contact with the roller. In addition, by separating the feed roller and the guide rollers from the recording medium in the non-circumferential surface after delivering the uppermost recording medium, it is possible to suppress unnecessary back tension acting on the recording medium fed to the downstream side. In addition, since the feed roller and the guide rollers are configured to be synchronously rotated by the rotary driving of the rotary shaft, it is possible to perform separation in the second outer circumferential surface and the gate member while delivering the recording medium in a state of being in contact with the first outer circumferential surface, by aligning the positions of the circumferential surface and the non-circumferential surfaces. The second outer circumferential surface is set such that the friction force with the recording medium is less than the friction force generated between the plurality of recording mediums when the guide rollers are rotated in a state of being in contact with the recording medium. Accordingly, even when the guide rollers are synchronously rotated with the feed roller and are in contact with the gate member without sandwiching the recording medium therebetween, since large friction force is not applied to the gate member, it is possible to suppress a unnecessary load applied to the gate member.

The feed device of the invention, the feed roller may have a circumferential surface having a distance from the rotary shaft as a radius and a non-circumferential surface having a distance from the rotary shaft shorter than that of the circumferential surface in the outer circumferential surface, and the circumferential surface of the feed roller may form the first outer circumferential surface, each of the guide rollers may have a circumferential surface having the distance from the rotary shaft as a radius over the overall circumference of the outer circumferential surface, and the circumferential surface of each of the guide rollers may form the second outer circumferential surface, and the feed roller may be rotated by the rotary driving of the rotary shaft, and the guide rollers may not be rotated by the rotary driving of the rotary shaft.

By this configuration, since the feed roller has the circumferential surface and the non-circumferential surface in the outer circumferential surface thereof, the recording medium is delivered by the circumferential surface and the non-circumferential surface can be set so as not to be in contact with the recording medium. Accordingly, by separating the non-circumferential surface from the recording medium after the uppermost recording medium is delivered by the circumferential surface, it is possible to suppress unnecessary back tension acting on the recording medium fed to the downstream side. Since the guide rollers have the circumferential surface forming the second outer circumferential surface over the overall circumference of the outer circumferential surface, it is possible to prevent the recording mediums loaded in the stacked state from being avalanched and double fed while the gate member separates from the circumferential surface. In addition, since the guide rollers are not rotated by the rotary driving of the rotary shaft, when the guide rollers are in contact with the gate member in a state in which the recording medium is not sandwiched therebetween, the guide rollers may not be rotated by the energizing force of the gate energizing member. Accordingly, it is possible to suppress an unnecessary load applied to the gate member by the sliding of the guide rollers.

The feed device of the invention may further include an auxiliary roller configured to be moved in a direction approaching or separating to or from the first outer circumferential surface at the downstream side of the inclined surface of the gate member in the feed direction of the recording mediums; and an auxiliary roller energizing member which energizes the auxiliary roller in the direction approaching the first outer circumferential surface, and the uppermost recording medium which is delivered by the delivery mechanism so as to pass through the gap formed between the delivery mechanism and the gate member may be sandwiched between the first outer circumferential surface and the outer circumferential surface of the auxiliary roller and may be fed by the feed operation of the delivery mechanism.

By this configuration, since the auxiliary roller is provided at the position corresponding to the downstream side of the inclined surface of the gate member in the feed direction of the recording medium, it is possible to feed the uppermost recording medium separated by the gate member with certainty.

According to another aspect of the invention, there is provided a recording device including a recording unit which performs recording with respect to a recording medium, and the feed device which feeds the recording medium to the recording unit.

By this configuration, the same effects as the feed device can be obtained.

BRIEF DESCRIPTION OF THE DRAWINGS

The invention will be described with reference to the accompanying drawings, wherein like numbers reference like elements.

FIG. 4 is a schematic side view explaining the operation of the auto feed device according to the first embodiment of the invention, wherein

FIG. 5 is a schematic side view explaining the operation of the auto feed device according to the first embodiment of the invention, wherein

FIG. 6 is a schematic side view explaining the operation of the auto feed device according to the first embodiment of the invention, wherein

FIG. 7 is a schematic side view explaining the operation of the auto feed device according to the first embodiment of the invention, wherein

FIG. 8 is a schematic side view explaining the operation of a guide roller and a gate member according to a second embodiment of the invention, wherein

FIG. 9 is a schematic side view explaining the operation of a guide roller and a gate member according to a second embodiment of the invention, wherein

DESCRIPTION OF EXEMPLARY EMBODIMENTS

First Embodiment

Hereinafter, an embodiment of an ink jet printer (hereinafter, referred to as a "printer") which is implemented as a recording device including a feed device of the invention will be described with reference to FIGS. 1 to 7. In the following description, terms "front-and-rear direction", "left-and-right direction" and "up-and-down direction" indicate directions denoted by arrows of the drawings, respectively.

Figure 1:
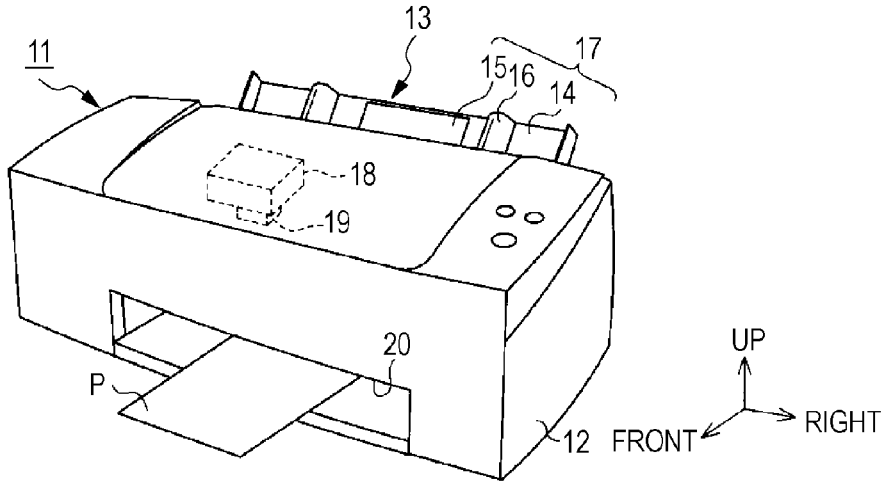
FIG. 1 is a perspective view of an ink jet printer according to a first embodiment of the invention.

As shown in FIG. 1, the printer 11 according to the present embodiment includes an auto paper feed device 13 functioning as the feed device for feeding paper P as a recording medium, on the rear surface side of a main body 12. The auto paper feed device 13 includes a paper guide 17 functioning as a loading unit and having a paper feed tray 14, a hopper 15 and an edge guide 16. In addition, the auto paper feed device 13 includes a paper feed driving mechanism (not shown) for feeding a plurality of sheets of paper P loaded in the paper guide 17 in a stacked state into the main body 12 one by one.

A carriage 18 which reciprocally moves in a main scan direction (the left-and-right direction of FIG. 1) is provided in the main body 12, and a recording head 19 functioning as a recording unit is provided under the carriage 18. Printing (recording) onto paper P is performed by alternately repeating a recording operation for ejecting an ink from the recording head 19 onto paper P while the carriage 18 moves in the main scan direction and a paper feed operation for feeding the paper P in a sub scan direction (a front direction) by a predetermined feed amount. In addition, the printed paper P is ejected from an ejection port 20 formed in a lower side of a front surface of the main body 12.

Next, the auto paper feed device 13 will be described with reference to FIGS. 2 and 3.

Figure 2:
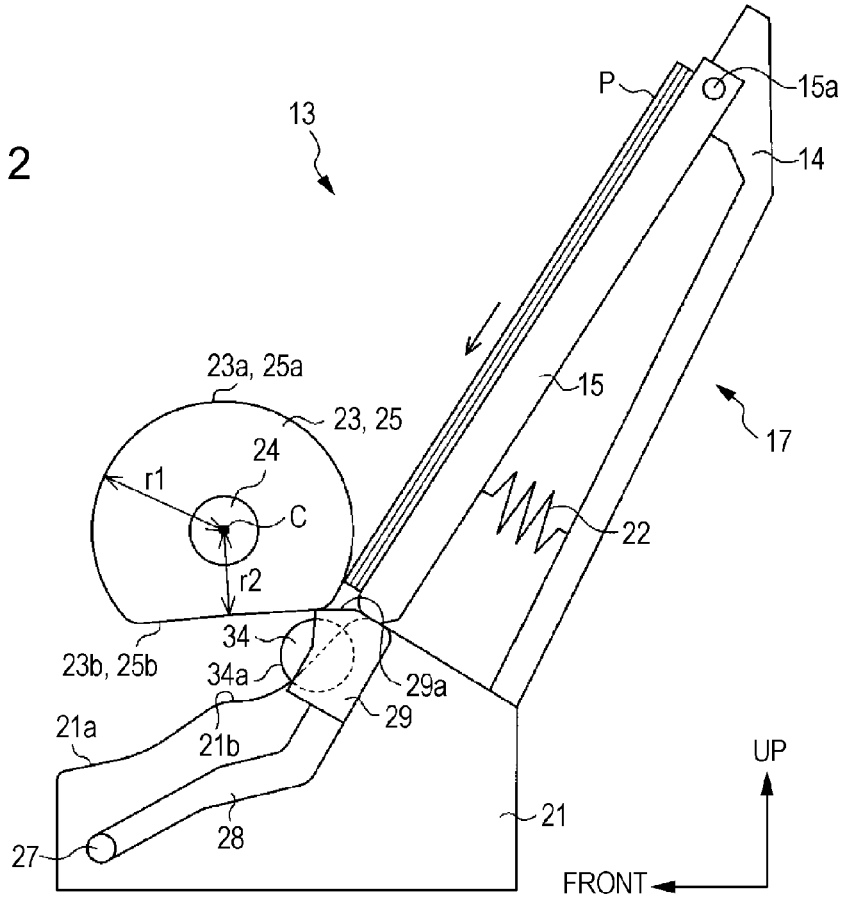
FIG. 2 is a schematic side view explaining an auto feed device according to the first embodiment of the invention.
Figure 3:
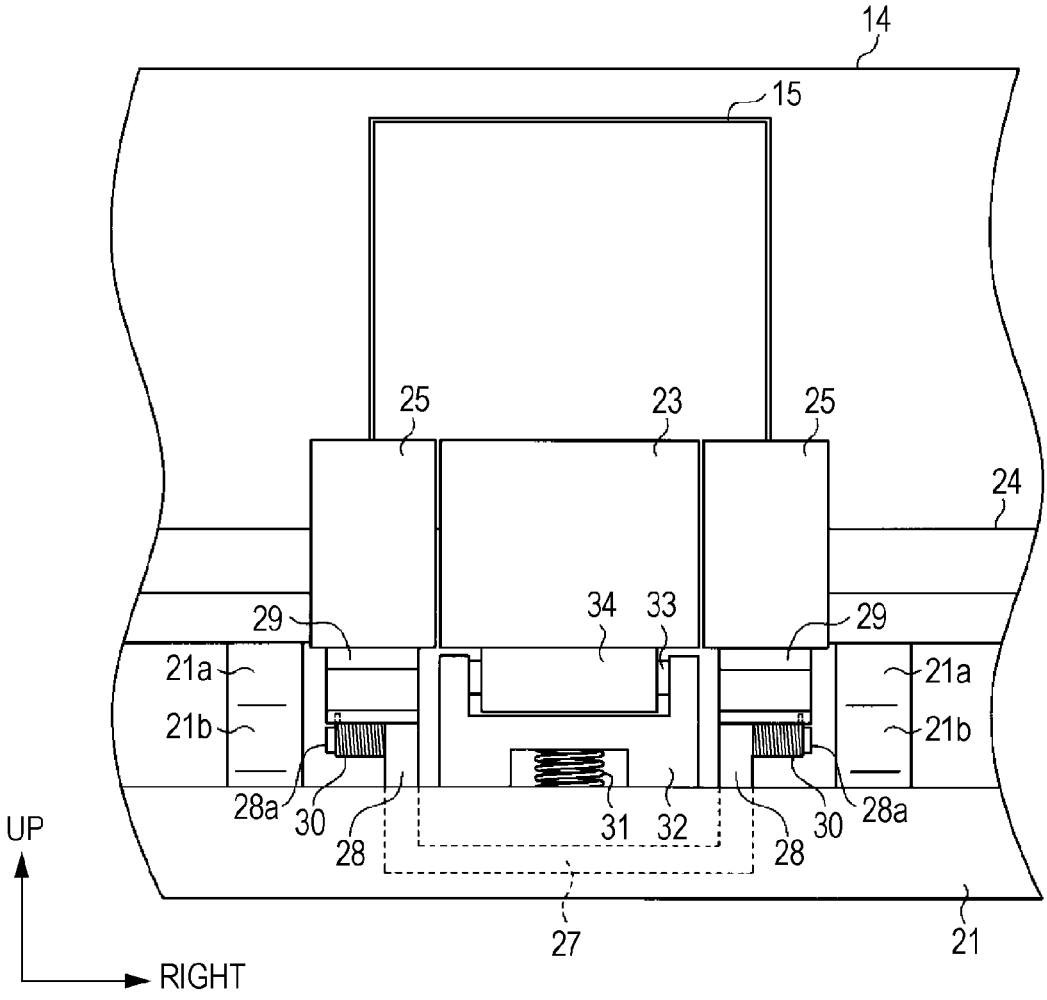
FIG. 3 is a partial front view explaining the auto feed device according to the first embodiment of the invention.

As shown in FIGS. 2 and 3, a lower end side of the paper feed tray 14 obliquely disposed on the rear surface of the main body 12 is supported by a rear side of a base portion 21, and the hopper 15 is provided on the upper surface of the paper feed tray 14 in the vicinity of the central portion of the left-and-right direction. A compression spring 22 is interposed between the hopper 15 and the paper feed tray 14 at a lower end side thereof. The hopper 15 is configured to be moved around a shaft 15*a* provided on an upper end side thereof between a paper feed position shown in FIG. 2 and a retreated position (see FIG. 4) in which the compression spring 22 is more compressed than in a state shown in FIG. 2 and the lower end side of the hopper 15 is moved in a counterclockwise direction. In FIG. 3, for convenience of understanding of the drawing, the paper P is not shown.

As shown in FIG. 2, a paper feed roller 23 functioning as a feed roller having a substantially D-shape in side view is disposed at the front side in the vicinity of the lower end of the hopper 15 located at the paper feed position so as to be rotated around a rotary shaft 24. As shown in FIG. 3, guide rollers 25 having a substantially D-shape in side view are disposed at both sides of the paper feed roller 23 in an axial direction (the left-and-right direction of FIG. 3) of the rotary shaft 24 so as to be rotated around the rotary shaft 24. The paper feed roller 23 and the guide rollers 25 are synchronously rotated by the rotary driving of the rotary shaft 24 so as to perform the feed operation of the paper P.

As shown in FIG. 2, the paper feed roller 23 and the guide rollers 25 have a circumferential surface 23*a* functioning as a first outer circumferential surface having a distance r1 from the shaft center C of the rotary shaft 24 as a radius and circumferential surfaces 25*a* functioning as a second outer circumferential surface at their outer circumferential surfaces thereof, respectively. In addition, the paper feed roller 23 and the guide rollers 25 have flat surfaces 23*b* and 25*b* as non-circumferential surfaces having a distance r2 (r2<r1) from the shaft center C of the rotary shaft 24 shorter than that of the circumferential surfaces 23*a* and 25*a* at their outer circumferential surfaces, respectively. The two guide rollers 25 have the same shape, and the width of the paper feed roller 23 in the left-and-right direction greater than that of the guide rollers 25. In addition, the circumferential surface 23*a* and the circumferential surfaces 25*a* are flushed with each other, and the flat surface 23*b* and the flat surface 25*b* are flushed with each other. In the present embodiment, the paper feed roller 23 and the guide rollers 25 configure a delivery mechanism.

When the paper feed roller 23 and the guide rollers 25 are rotated in a state in which the hopper 15 is located at the paper feed position, the flat surfaces 23*b* and 25*b* are not in contact with the paper P, but the circumferential surfaces 23*a* and 25*a* are in contact with the paper P. In addition, the distances r1 and r2 from the shaft center C of the rotary shaft 24 are set such that the paper P is pressed on the circumferential surfaces 23*a* and 25*a* by the energizing force of the compression spring 22. The circumferential surface 23*a* of the paper feed roller 23 is formed of rubber having elasticity, and the circumferential surfaces 25*a* of the guide rollers 25 are formed of plastic having hardness higher than that of the circumferential surface 23*a*. When the paper feed roller 23 is rotated in a state in which the circumferential surface 23*a* and the paper P are in contact with each other, friction force with the paper P is set to be greater than friction force generated between the stacked sheets of paper P. In contrast, when the guide rollers 25 are rotated in a state in which the circumferential surfaces 25*a* and the paper P are in contact with each other, friction force with the paper P is set to be less than friction force between the stacked sheets of paper P.

Accordingly, when the paper feed roller 23 and the guide rollers 25 are rotated in a state of being in contact with the paper P, the energizing force of the compression spring 22 becomes vertical resisting force and the friction force generated between the circumferential surface 23*a* and the paper P becomes feed force, such that the paper P is delivered. In addition, since the friction force generated between the circumferential surfaces 25*a* and the paper P is set to be less than the friction force generated between the sheets of paper P, the feed force for delivering the paper P is not generated.

As shown in FIGS. 2 and 3, guides 21*a* obliquely extending forward and downward are formed on the front side of the base portion 21 at positions which become the outsides of the guide rollers 25 in the left-and-right direction. Banks 21*b* (see FIG. 2) having a gentle projecting shape in side view are formed in the vicinities of the centers of the front-and-rear direction of the guides 21*a*.

Arm members 28 of which lower end sides are oscillatorily supported by the base portion 21 with an axial portion 27 interposed therebetween are obliquely disposed inside both the guides 21*a* of the base portion 21 at positions corresponding to both the guide rollers 25, and gate members 29 are attached to upper ends of the arm members 28 so as to individually correspond to both the guide rollers 25. As shown in FIG. 2, inclined surfaces 29*a* which protrude upward rather than the guides 21*a* of the base portion 21 such that the paper P delivered from the paper feed tray 14 collides therewith at a predetermined angle are formed in the gate members 29.

As shown in FIG. 3, torsion coil springs 30 functioning as a gate energizing member are hung in convex portions 28*a* provided outward in the vicinities of the upper ends of the arm members 28. One end of each of the torsion coil springs 30 is locked to a locking portion (not shown) provided in the base portion 21 and the other end of each of the torsion coil springs 30 is locked to a locking portion (not shown) provided in each of the gate members 29.

The gate members 29 are not in contact with the guide rollers 25 when facing the vicinities of the centers of the flat surfaces 25*b* of the guide rollers 25, but are rotated around the axial portion 27 in the clockwise direction of FIG. 2 so as to be in contact with the circumferential surfaces 25*a* of the guide roller 25 when facing the circumferential surfaces 25*a*. In addition, when the gate members 29 are in contact with the circumferential surfaces 25*a*, the torsion coil spring 30 are energized in a direction in which the gate members 29 approach to the circumferential surfaces 25*a*.

When the paper P is fed, as shown in FIG. 2, after the guide rollers 25 are brought into contact with the gate members 29, the hopper 15 is moved from the retreated position to the paper feed position. In addition, when the paper P is delivered by the rotated paper feed roller 23 in the feed direction denoted by arrow in FIG. 2, the front end of the uppermost sheet of paper P collides with the inclined surfaces 29*a* of the gate members 29.

At this time, the gate members 29 are moved from the state of FIG. 2 to the position abutting on the circumferential surfaces 25*a*, but the gate members 29 are moved against the energizing force of the torsion coil springs 30 in a direction (clockwise direction of FIG. 2) separating from the circumferential surfaces 25*a* by a distance corresponding to the thickness of the uppermost sheet of paper P, by the pressing force when the uppermost sheet of paper P collides with the inclined surfaces 29*a*. That is, when the uppermost sheet of paper P delivered by the paper feed roller 23 collides with the inclined surfaces 29*a*, a contact angle between the inclined surfaces 29*a* and the paper P or the energizing force of the torsion coil springs 30 is set such that the gap through which only a single sheet of paper P passes is formed between the guide rollers 25 and the gate members 29.

Meanwhile, the underlying paper P does not have the feed force capable of moving the gate members 29 against the energizing force of the torsion coil springs 30 when colliding with the inclined surfaces 29*a* of the gate members 29. Accordingly, even when the underlying paper P is pulled to the uppermost sheet of paper P delivered by the paper feed roller 23 by the friction force, the underlying paper P is prevented from being fed due to collision with the inclined surfaces 29*a* of the gate members 29 and thus is separated from the uppermost sheet of paper P.

A slider 32 which is moved in a direction which approaches to or separates from the paper feed roller 23 with a coil spring 31 interposed therebetween as an auxiliary roller energizing member, of which a lower end side is supported by the base portion 21, is provided inside the gate members 29 at a position corresponding to the paper feed roller 23. In addition, an auxiliary roller 34 which is supported so as to be rotated around a rotary shaft 33 is provided on the upper end of the slider 32.

The auxiliary roller 34 is not in contact with the paper feed roller 23 when facing the vicinity of the center of the flat surface 23*b* of the paper feed roller 23, but is moved together with the slider 32 so as to be in contact with the circumferential surface 23*a* of the paper feed roller 23 when facing the circumferential surface 23*a*. When the auxiliary roller 34 is in contact with the circumferential surface 23*a*, the coil spring 31 is energized in the direction in which the auxiliary roller 34 approaches to the circumferential surface 23*a*.

In addition, in the feed direction of the paper P denoted by arrow in FIG. 2, the auxiliary roller 34 is located at the downstream side of the inclined surfaces 29*a* of the gate members 29. That is, when the paper feed roller 23 and the guide rollers 25 are synchronously rotated by the rotary driving of the rotary shaft 24, the guide rollers 25 first press and move the gate members 29 and then the paper feed roller 23 presses and moves the auxiliary roller 34.

In addition, the outer circumferential surface 34*a* of the auxiliary roller 34 is formed of rubber having elasticity. In addition, when the paper feed roller 23 is rotated in a state in which the auxiliary roller 34 is in contact with the paper feed roller 23, the auxiliary roller 34 is rotated. In addition, when the paper P passing through the gate members 29 is fed from the upstream side in a state in which the auxiliary roller 34 is rotated by the paper feed roller 23, the paper P is sandwiched between the circumferential surface 23*a* and the outer circumferential surface 34*a* of the auxiliary roller 34 such that the auxiliary roller 34 is separated from the circumferential surface 23*a* by the distance corresponding to the thickness of a single sheet of paper P. In addition, the paper P is fed to the recording head 19 by the rotation of the paper feed roller 23.

Next, the operation of the auto paper feed device 13 having the above-described configuration will be described with reference to FIGS. 4 to 7.

Figure 4B:
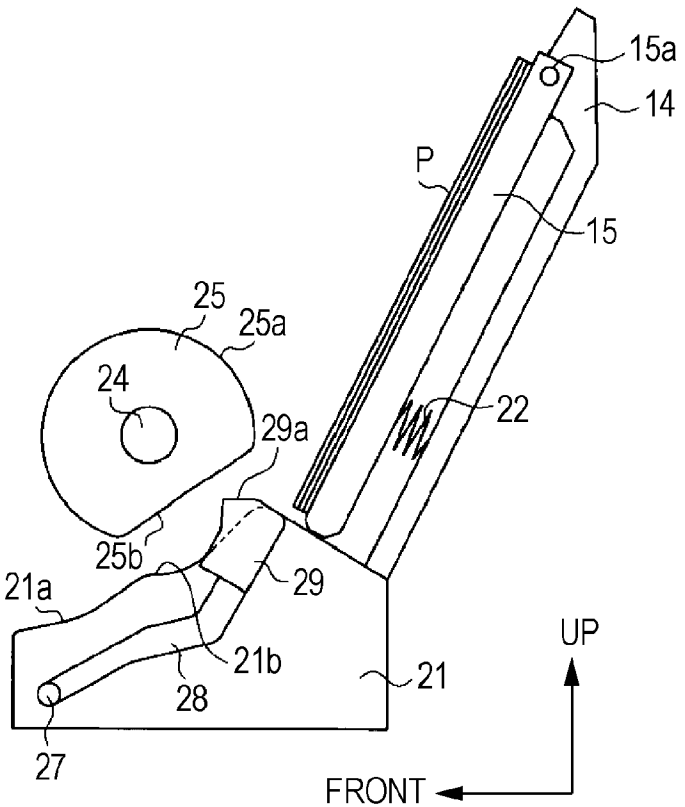
FIGS. 4A and 4B show a reset state.
Figure 4A:
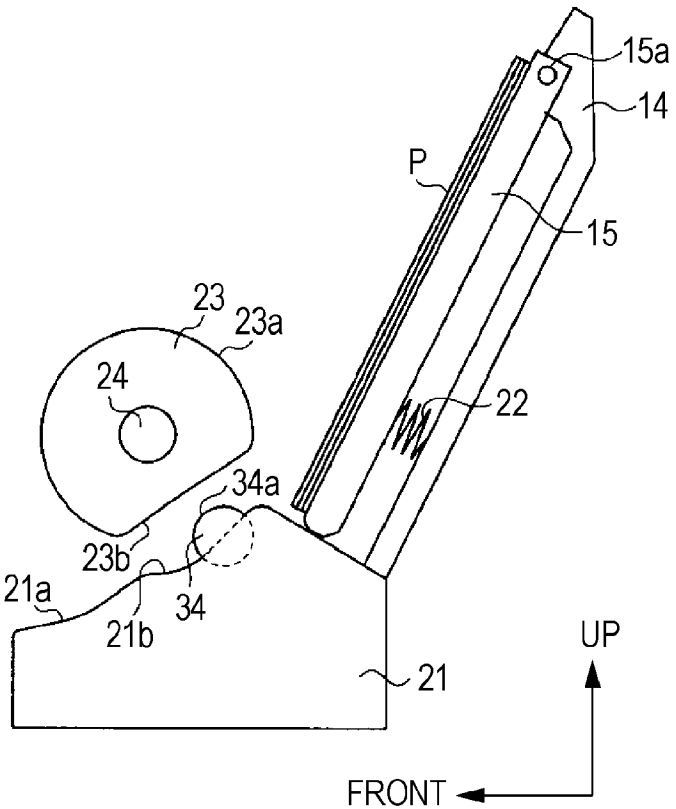

In a reset state shown in FIGS. 4A and 4B, the paper feed roller 23 and the guide rollers 25 face the auxiliary roller 34 and the gate members 29 in the vicinity of the center of the flat surfaces 23*b* and 25*b*, and the hopper 15 is located at the retreated position separating from the paper feed roller 23.

Figure 5B:
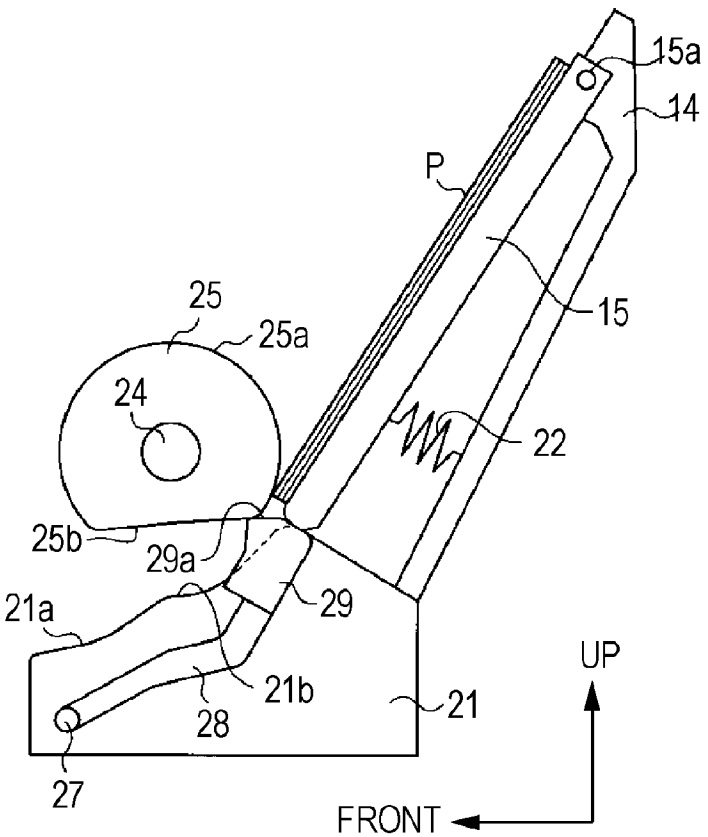
FIGS. 5A and 5B show a delivery state.
Figure 5A:
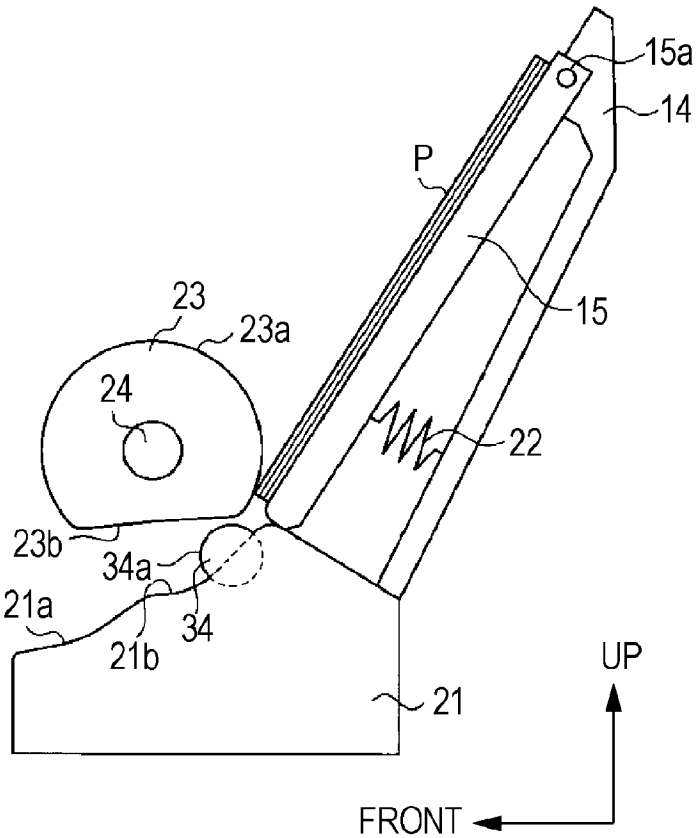

When the rotation of the rotary shaft 24 is started and the paper feed roller 23 and the guide rollers 25 are rotated in the clockwise direction of FIG. 4, as shown in FIG. 5B, the guide rollers 25 are brought into contact with the gate members 29. At this time, as shown in FIG. 5A, the paper feed roller 23 is not brought into contact with the auxiliary roller 34. After the guide rollers 25 are brought into contact with the gate members 29, the hopper 15 is moved from the retreated position to the paper feed position and the uppermost sheet of paper P is brought into contact with the circumferential surface 23*a*. After the guide rollers 25 press and move the gate members 29, the paper feed roller 23 is brought into contact with the auxiliary roller 34, and the rotation of the auxiliary roller 34 is started by the rotation of the paper feed roller 23.

Figure 6B:
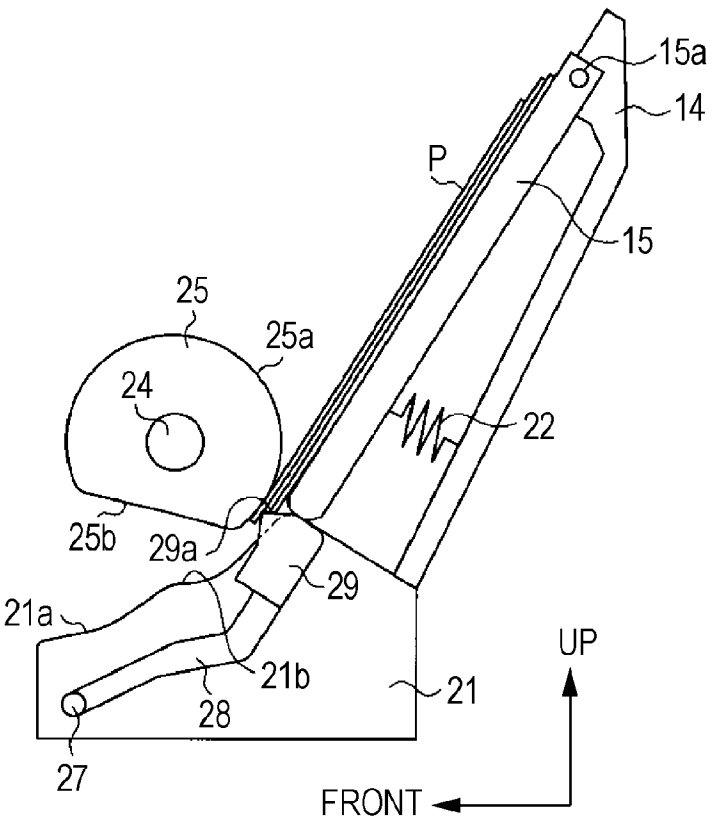
FIGS. 6A and 6B show a separation state.

When the paper feed roller 23 and the guide rollers 25 are further rotated, the front end of the uppermost sheet of paper P delivered by the paper feed roller 23 collides with the inclined surfaces 29*a* of the gate members 29. Then, as shown in FIG. 6B, the gate members 29 are moved against the energizing force of the torsion coil springs 30 in the direction (the clockwise direction of FIG. 6) separating from the circumferential surfaces 25*a*, the gap through which only the uppermost sheet of paper P can pass is formed between the circumferential surfaces 25*a* and the gate members 29, and the uppermost sheet of paper P passes through this gap. At this time, the uppermost sheet of paper P and its underlying paper P are delivered by friction force with the paper P, but the underlying paper P is prevented from being fed due to the collision with the inclined surfaces 29*a* of the gate members 29 and thus is separated from the uppermost sheet of paper P.

Figure 6A:
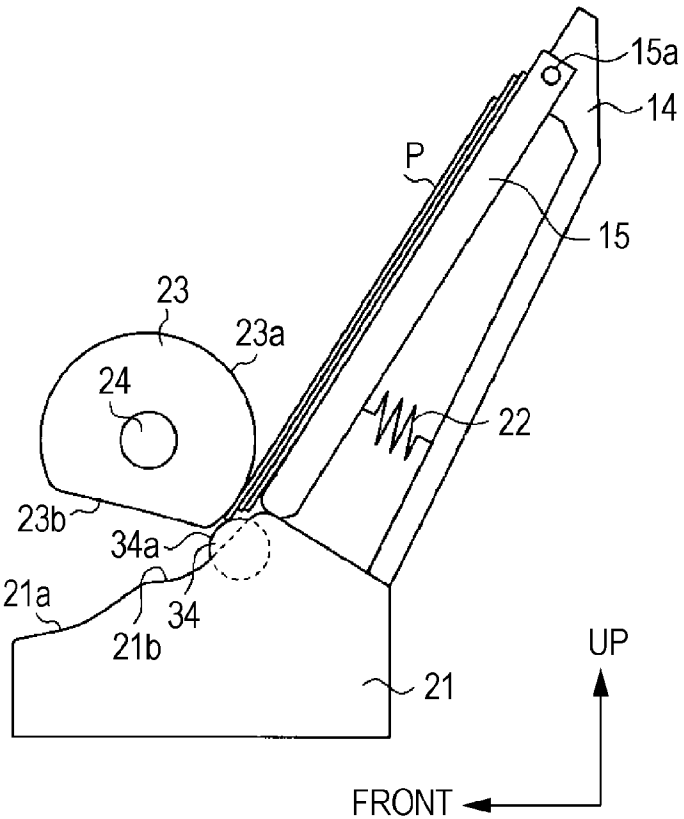
Figure 7B:
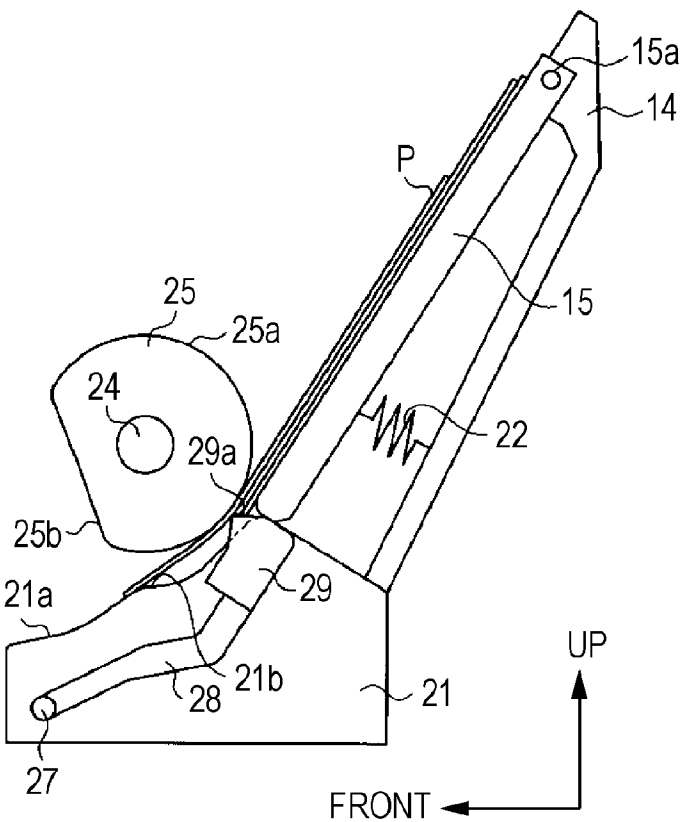
FIGS. 7A and 7B show a feed state.
Figure 7A:
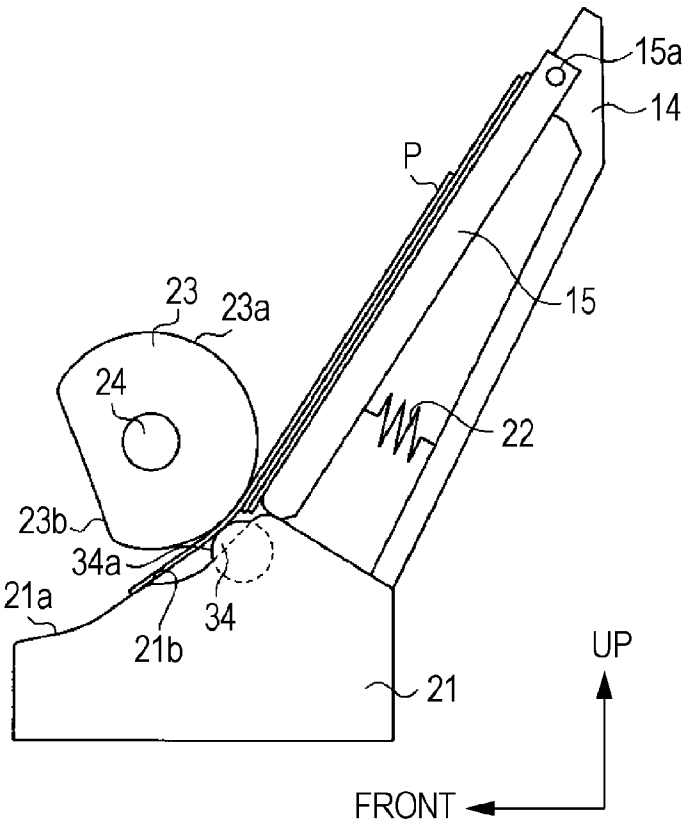

The front end of the uppermost sheet of paper P passing between the circumferential surfaces 25*a* and the gate members 29 is sandwiched between the circumferential surface 23*a* and the outer circumferential surface 34*a* of the auxiliary roller 34, as shown in FIG. 6A, and is fed to the downstream side by the rotation of the paper feed roller 23. The front end of the uppermost sheet of paper P reaches the banks 21*b* of the base portion 21 as shown in FIGS. 7A and 7B and the hopper 15 is then moved from the paper feed position to the retreated position. Thereafter, the feed force based on the vertical resisting force of the compression spring 22 given to the uppermost sheet of paper P is removed, but the uppermost sheet of paper P is sandwiched between the paper feed roller 23 and the auxiliary roller 34 and thus is fed to the recording head 19 by the feed force based on the rotation of the paper feed roller 23.

According to the above-described first embodiment, the following effects can be obtained.

(1) The uppermost sheet of paper P which is delivered by the paper feed roller 23 such that the front end thereof collides with the inclined surfaces 29*a* of the gate members 29 is fed against the energizing force of the torsion coil springs 30 while forming the gap, through which only a single sheet of paper P can pass, between the circumferential surfaces 25*a* and the gate members 29 such that the uppermost sheet of paper P and its underlying paper P are separated so as to prevent double feed.

(2) The paper feed roller 23 has the circumferential surface 23*a* which is set such that the friction force with the paper P is greater than the friction force between the plurality of sheets of paper P when the feed operation is performed in a state of being in contact with the paper P, and the guide rollers 25 have the circumferential surfaces 25*a* having hardness higher than that of the circumferential surface 23*a*. Accordingly, the circumferential surface 23*a* is formed of rubber capable of obtaining high friction force, and the circumferential surfaces 25*a* is formed of plastic which has hardness higher than that of rubber and is hard to be deformed. Therefore, the paper P is fed to the circumferential surface 23*a*, and the circumferential surfaces 25*a* of which the deformation of the outer circumferential surfaces is suppressed separate the paper P in cooperation with the gate members 29 energized by the torsion coil spring 30, thereby preventing the double feed of the paper P with high precision.

(3) Since the feed operation is realized by the rotation of the paper feed roller 23 and the guide rollers 25, it is possible to deliver the paper P with smooth and continuous motion.

(4) Since the circumferential surface 23*a* and the circumferential surfaces 25*a* are configured by the paper feed roller 23 and the guide rollers 25 which are supported to be rotated around the same rotary shaft 24, a separate rotary shaft for supporting the guide rollers 25 is unnecessary and the increase in the number of parts can be suppressed.

(5) Since the paper P can be delivered by the paper feed roller 23 located at the central portion in the width direction of the paper P and the paper P can be separated by the guide rollers 25 and the gate members 29 positioned at both sides of the paper feed roller 23, it is possible to perform separation with certainty without tilting the paper P in the feed direction.

(6) Since the circumferential surface 23*a* and the circumferential surfaces 25*a* are flush with each other, it is possible to perform separation with certainty without causing unbalance in pressure due to the contacting of the gate members 29 or the gap formed with the gate members 29.

(7) Since the auxiliary roller 34 is provided at the position which is the downstream side of the inclined surfaces 29*a* of the gate members 29 in the feed direction of the paper P, it is possible to feed the uppermost sheet of paper P separated by the gate members 29 to the recording head 19 with certainty.

(8) Since the paper feed roller 23 and the guide rollers 25 respectively have the circumferential surfaces 23*a* and 25*a* and the flat surfaces 23*b* and 25*b* at their outer circumferential surfaces, it is possible to deliver and separate the paper P by the circumferential surfaces 23*a* and 25*a* and to set the flat surfaces 23*b* and 25*b* so as not to be in contact with the paper P or the gate members 29. Accordingly, it is possible to suppress the deformation of the outer circumferential surface, compared with the case of being always in contact with the gate members 29.

(9) By separating the paper feed roller 23 and the guide rollers 25 from the paper P in the flat surfaces 23*b* and 25*b* after delivering the uppermost sheet of paper P, it is possible to suppress unnecessary back tension acting on the paper P fed to the downstream side.

(10) Since the paper feed roller 23 and the guide rollers 25 are configured so as to be synchronously rotated by the rotary driving of the rotary shaft 24, it is possible to perform separation in the circumferential surfaces 25*a* and the gate members 29 while delivering the paper P in a state of being in contact with the circumferential surface 23*a*, by aligning the positions of the circumferential surfaces 23*a* and 25*a* and the flat surfaces 23*b* and 25*b*.

(11) The circumferential surfaces 25*a* are set such that the friction force with the paper P is less than the friction force generated between the plurality of sheets of paper P when the guide rollers 25 are rotated in a state of being in contact with the paper P. Accordingly, even when the guide rollers 25 are synchronously rotated with the paper feed roller 23 and are in contact with the gate members 29 without sandwiching the paper P therebetween, since large friction force is not applied to the gate members 29, it is possible to suppress a unnecessary load applied to the gate members 29.

Second Embodiment

Next, a second embodiment of a serial type ink jet printer which is implemented as the liquid ejecting device of the invention will be described with reference to FIGS. 8 and 9.

The present embodiment is similar to the first embodiment in that, in the auto paper feed device 13 functioning as the feed device included in the printer 11 functioning as the recording device, the paper P is fed in cooperation with the paper feed roller 23 and the auxiliary roller 34 and the separation of the paper P is performed in cooperation with the guide rollers 25 and the gate members 29, and is different in that the guide rollers 25A of the present embodiment are circular rollers having a circular shape in side view.

Hereinafter, the present embodiment will be described concentrating on portions different from those of the first embodiment.

As shown in FIGS. 8 and 9, the guide rollers 25A have circumferential surfaces 25*a* as second outer circumferential surfaces over the overall circumference surrounding the rotary shaft 24. Accordingly, the gate members 29 are in contact with the circumferential surfaces 25*a* of the guide rollers 25A, and the torsion coil springs 30 are energized in the direction in which the gate members 29 approach to the circumferential surfaces 25*a*.

The guide rollers 25A are freely rotated around the rotary shaft 24. Accordingly, even when the paper feed roller 23 performs the rotation operation as the paper feed operation (feed operation) by the rotary driving of the rotary shaft 24, the guide rollers 25A are not rotated.

Next, the operation of the auto paper feed device 13 having the above-described configuration will be described.

Figure 8B:
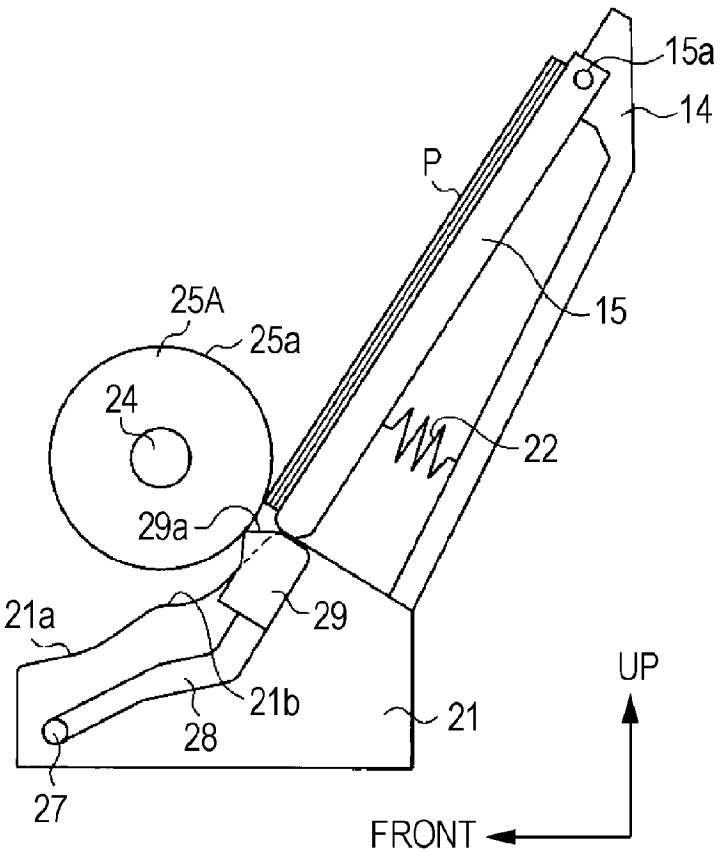
FIG. 8A shows a reset state and FIG. 8B shows a delivery state.
Figure 8A:
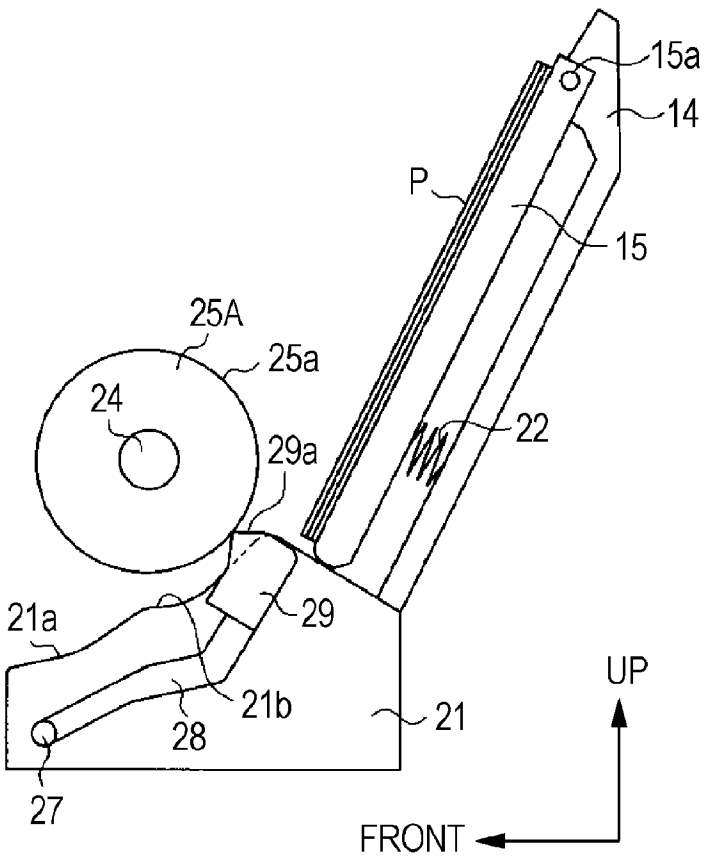

The guide rollers 25A are in contact with the gate members 29 energized by the torsion coil springs 30 at the reset position shown in FIG. 8A. Accordingly, even when the sheets of paper P obliquely stacked are avalanched, the sheets of paper can be blocked by the inclined surfaces 29*a* of the gate members 29.

When the rotary driving of the rotary shaft 24 is started and the paper feed roller 23 is rotated in the clockwise direction of FIG. 8, as shown in FIG. 8B, the hopper 15 is moved from the retreated position to the paper feed position and the paper P is brought into contact with the circumferential surface 23*a*. At this time, the guide rollers 25A are in contact with the gate members 29 so as to receive the energizing force of the torsion coil springs 30 and thus are not rotated.

When the paper feed roller 23 is rotated, the front end of the uppermost sheet of paper P delivered by the paper feed roller 23 collies with the inclined surfaces 29*a* of the gate members 29. Then, as shown in FIG. 9A, the gate members 29 are moved against the energizing force of the torsion coil springs 30 in the direction (clockwise direction of FIG. 9) separating from the circumferential surfaces 25*a*, the gap through which only the uppermost sheet of paper P can pass is formed between the circumferential surfaces 25*a* and the gate members 29, and the uppermost sheet of paper P passes through this gap. At this time, the uppermost sheet of paper P and its underlying paper P are delivered by the friction force with the paper P, but the underling paper P is prevented from being fed due to the collision with the inclined surfaces 29*a* of the gate members 29 and thus is separated from the uppermost sheet of paper P.

Figure 9B:
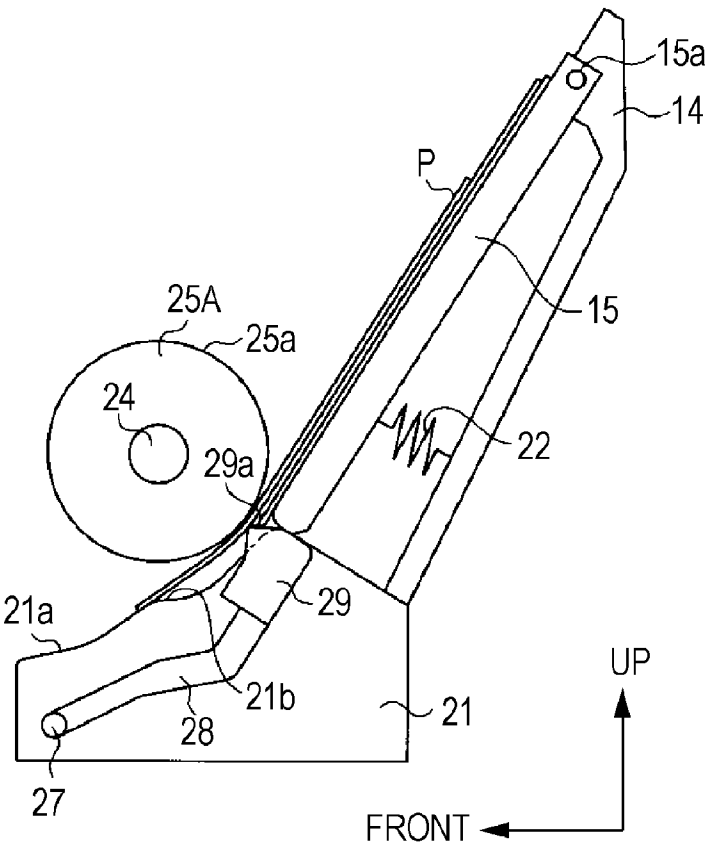
FIG. 9A shows a separation state and FIG. 9B shows a feed state.
Figure 9A:
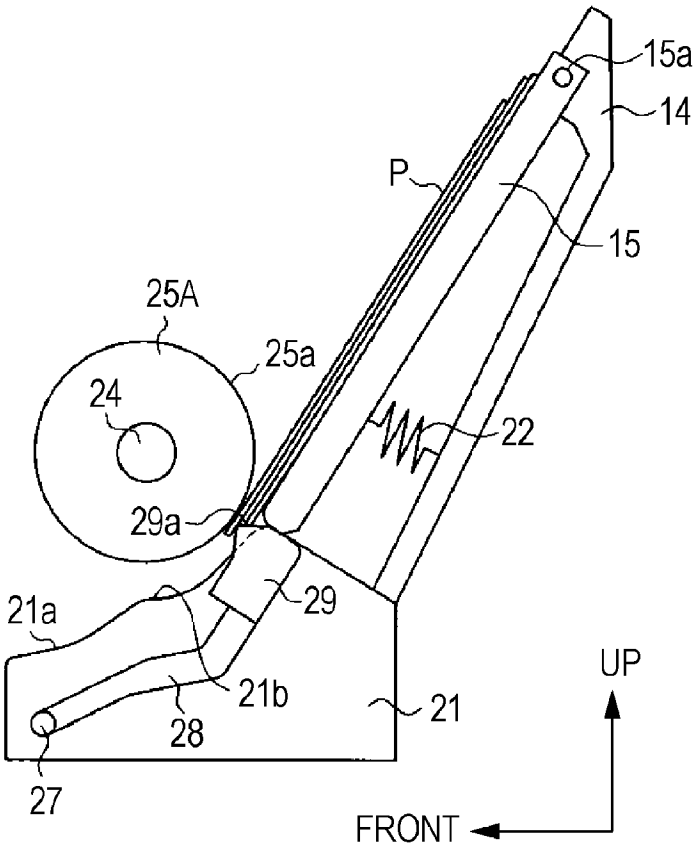

The front end of the uppermost sheet of paper P reaches the banks 21*b* of the base portion 21 as shown in FIG. 9B and the hopper 15 is then moved from the paper feed position to the retreated position. Thereafter, the feed force based on the vertical resisting force of the compression spring 22 given to the uppermost sheet of paper P is removed, but the uppermost sheet of paper P is sandwiched between the paper feed roller 23 and the auxiliary roller 34 and thus is fed to the recording head 19 by the feed force based on the rotation of the paper feed roller 23.

According to the above-described second embodiment, in addition to (1) to (7) of the first embodiment, the following effects can be obtained.

(12) Since the paper feed roller 23 has the circumferential surface 23*a* and the flat surface 23*b* in the outer circumferential surface thereof, the paper P is delivered by the circumferential surface 23*a* and the flat surface 23*b* is set so as not to be in contact with the paper P. Accordingly, by separating the flat surface 23*b* from the paper P after the uppermost sheet of paper P is delivered by the circumferential surface 23*a*, it is possible to suppress unnecessary back tension acting on the paper P fed to the downstream side.

(13) Since the guide rollers 25A have the circumferential surfaces 25*a* over the overall circumference thereof, it is possible to prevent the sheets of paper P loaded in the stacked state from being avalanched and double fed while the gate members 29 separate from the circumferential surfaces 25*a*.

(14) Since the guide rollers 25A are not rotated by the rotary driving of the rotary shaft 24, when the guide rollers 25A are in contact with the gate members 29 in a state in which the paper P is not sandwiched therebetween, the guide rollers 25A may not be rotated by the energizing force of the torsion coil springs 30. Accordingly, it is possible to suppress an unnecessary load applied to the gate members 29 by the sliding of the guide rollers 25A.

(15) The circumferential surfaces 25*a* are set such that the friction force with the paper P is less than the friction force generated between the plurality of sheets of paper P when the guide rollers 25 are rotated in a state of being in contact with the paper P. Accordingly, even when the paper P delivered by the paper feed roller 23 is sandwiched between the guide rollers 25 and the gate members 29, since the friction force generated between the guide rollers 25 and the paper P is small, it is possible to decrease force suppressing the feed.

In addition, the above-described embodiments may be modified to the following embodiments.

The paper feed operation is not limited to the rotation of the paper feed roller 23 and may be, for example, realized by the movement of a transport belt.

The delivery mechanism may not include the guide rollers. For example, one paper feed roller including a first outer circumferential surface and a second outer circumferential surface which are adjacent to each other in the axial direction may be used.

A guide roller 25 may be disposed at the central portion of the axial direction and feed rollers 23 may be disposed at both sides thereof.

The paper feed roller 23 may be a circular roller having a circular shape in side view.

The movement of the gate members 29 is not limited to rotation, and, for example, reciprocal movement using a slider with a coil spring interposed therebetween may be realized.

Although the ink jet printer is employed in the above-described embodiments, a liquid ejecting device for ejecting or discharging a liquid other than an ink may be employed or various types of liquid ejecting devices including a liquid ejecting head for ejecting a small amount of liquid droplets may be used. In addition, the liquid droplets indicate a liquid state discharged from the liquid ejecting device and include a particle shape, a tear shape, and a filamentous shape with a tail. The term "liquid" described herein is a material which may be ejected by the liquid ejecting device, may be, for example, a state when a material is a liquid, and includes a liquid state with high or low viscosity, a fluid state such as sol, gel water, another inorganic solvent, an organic solvent, a solution, liquid resin or liquid metal (metallic melt), a liquid as a state of a material, and a material obtained by melting, dispersing or mixing particles of a function material made of a solid such as pigment or metal particles in a solvent. Representative examples of the liquid include liquid crystal or the ink described in the above embodiments. The ink includes various kinds of liquid compositions such as a general aqueous ink, oil-based ink, gel ink, or hot melt ink. The detailed examples of the liquid ejecting device includes, for example, a liquid ejecting device for ejecting a liquid including a material such as an electrode material or a coloring material used for manufacturing a liquid crystal display, an electroluminescence (EL) display, a surface light emission display or a color filter in a dispersed or solved state, a liquid ejecting device for ejecting a bio-organic matter used for manufacturing a bio chip, a liquid ejecting device for ejecting a liquid, which is a sample and is used as a precision pipette, a printing device, a micro dispenser and the like. In addition, a liquid ejecting device for ejecting a lubricant to a precision machine such as a watch or camera at a pinpoint, a liquid ejecting device for ejecting a transparent resin liquid such as ultraviolet curing resin onto a substrate in order to form a minute semi-spherical lens (optical lens) used in an optical communication element or the like, or a liquid ejecting device for ejecting an etchant such as acid or alkali in order to etch a substrate or the like may be used. Any one of them is applicable to the invention.

What is claimed is:

1. A feed device comprising:

a loading unit in which a plurality of recording mediums is loaded in a stacked state;

a delivery mechanism which has a first outer circumferential surface set such that friction force with the recording mediums is greater than friction force generated among the plurality of recording mediums when a feed operation is performed in a state of being in contact with the recording mediums and a second outer circumferential surface having a hardness higher than that of the first outer circumferential surface, and which performs the feed operation in a state in which at least the first outer circumferential is in contact with an uppermost recording medium of the recording mediums loaded on the loading unit so as to deliver the recording medium in a feed direction;

a gate member which is configured to move toward the second outer circumferential surface of the delivery mechanism or separate from the second outer circumferential surface of the delivery mechanism and which has an inclined surface with which a front end of the recording medium delivered by the delivery mechanism collides; and a gate energizing member which energizes the gate member in a direction approaching the second outer circumferential surface of the delivery mechanism, wherein, in the uppermost recording medium which is delivered by the delivery mechanism such that the front end thereof collides with the surface of the gate member, a gap through which only the uppermost recording medium may pass is formed between the delivery mechanism and the gate member by moving the gate member against the energizing force of the gate energizing member in the direction separating from the delivery mechanism, wherein the delivery mechanism includes a feed roller which has the first outer circumferential surface and which is supported so as to be rotated around a rotary shaft, and wherein the delivery mechanism also include a guide roller which has the second outer circumferential surface and which is supported so as to be rotated around the rotary shaft, such that the first outer circumferential surface is disposed at a different location from the second outer circumferential surface in an axis direction of the rotary shaft, and wherein the gate member is disposed opposite to the guide rollers without being disposed opposite to the feed roller such that the gate member contacts the second outer circumferential surfaces of the guide rollers as the guide rollers rotate around the rotary shaft without contacting the first outer circumferential surface of the feed roller.

2. The feed device according to claim 1, wherein the guide rollers are disposed at both sides of the feed roller in an axial direction of the rotary shaft, and the first outer circumferential surface of the feed roller and the second outer circumferential surface of the guide roller are substantially flush with each other.

3. The feed device according to claim 1, wherein:

each of the feed roller and the guide rollers has a circumferential surface having a distance from the rotary shaft as a radius and a non-circumferential surface having a distance from the rotary shaft shorter than that of the circumferential surface in the outer circumferential surface, the circumferential surface of the feed roller forms the first outer circumferential surface, and the circumferential surface of each of the guide rollers forms the second outer circumferential surface, the second outer circumferential surface is set such that friction force with the recording mediums is less than friction force generated between the plurality of recording mediums when the guide rollers are rotated in a state of being in contact with the recording mediums, and the feed roller and the guide rollers are configured to be synchronously rotated by the rotary driving of the rotary shaft.

4. The feed device according to claim 1, wherein:

the feed roller has a circumferential surface having a distance from the rotary shaft as a radius and a non-circumferential surface having a distance from the rotary shaft shorter than that of the circumferential surface in the outer circumferential surface, and the circumferential surface of the feed roller forms the first outer circumferential surface, each of the guide rollers has a circumferential surface having the distance from the rotary shaft as a radius over the overall circumference of the outer circumferential surface, and the circumferential surface of each of the guide rollers forms the second outer circumferential surface, and the feed roller is rotated by the rotary driving of the rotary shaft, and the guide rollers are not rotated by the rotary driving of the rotary shaft.

5. The feed device according to claim 1, further comprising:

an auxiliary roller configured to be moved in a direction approaching or separating from the first outer circumferential surface at the downstream side of the inclined surface of the gate member in the feed direction of the recording mediums; and an auxiliary roller energizing member which energizes the auxiliary roller in the direction approaching the first outer circumferential surface, wherein the uppermost recording medium which is delivered by the delivery mechanism so as to pass through the gap formed between the delivery mechanism and the gate member is sandwiched between the first outer circumferential surface and the outer circumferential surface of the auxiliary roller and is fed by the feed operation of the delivery mechanism.

6. A recording device comprising:

a recording unit which performs recording with respect to a recording medium; and a feed device according to claim 1, which feeds the recording medium to the recording unit.

* * * * *